US006627005B1

(12) United States Patent
Kawabe et al.

(10) Patent No.: US 6,627,005 B1
(45) Date of Patent: Sep. 30, 2003

(54) HIGH FATIGUE-STRENGTH STEEL WIRE AND SPRING, AND PROCESSES FOR PRODUCING THESE

(75) Inventors: Nozomu Kawabe, Hyogo (JP); Teruyuki Murai, Hyogo (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/530,451

(22) PCT Filed: Aug. 13, 1998

(86) PCT No.: PCT/JP98/03623

§ 371 (c)(1), (2), (4) Date: May 1, 2000

(87) PCT Pub. No.: WO99/24630

PCT Pub. Date: May 20, 1999

(30) Foreign Application Priority Data

Nov. 6, 1997 (JP) ..... 9-322495

(51) Int. Cl.[7] ..... C23C 8/32

(52) U.S. Cl. ..... 148/226; 148/307; 148/580; 148/595; 148/601; 148/602; 148/908

(58) Field of Search ..... 148/580, 595, 148/602, 601, 307, 908

(56) References Cited

U.S. PATENT DOCUMENTS 5,240,520 A * 8/1993 Tarui et al. ..... 148/532
5,904,830 A * 5/1999 Yamao et al. ..... 205/640

FOREIGN PATENT DOCUMENTS

| | | |
|---|---|---|
| JP | 57-140833 | 8/1982 |
| JP | 60-194046 | 10/1985 |
| JP | 62-260015 | 11/1987 |
| JP | 05-320827 | 12/1993 |

* cited by examiner

*Primary Examiner*—Roy King
*Assistant Examiner*—Andrew Wessman
(74) *Attorney, Agent, or Firm*—McDermott, Will & Emery

(57) ABSTRACT

A steel wire of pearlite structure containing 0.8–1.0 mass % of C and 0.8–1.5 mass % of Si is disclosed. In the cross section of the steel wire the average hardness in a region up to 100 $\mu$m from the surface thereof is at least 50 higher that that in a deeper region based on micro-Vickers hardness. The steel wire is manufactured by working a wire rod having the abovementioned chemical composition through shaving, patenting and drawing processes, then strain-relief annealing the resultant wire, and thereafter subjecting the thus annealed wire to a short peening process. The steel wire can be produced through a drawing process without applying a quenching and tempering process, and are superior in heat resistance and fatigue strength.

9 Claims, 6 Drawing Sheets

C=1.18
(X)
(X) C=0.98
(X) C=0.82
C=0.72
700
600
500
Fatigue limit amplitude stress (N/mm²)
0
0.2
0.5
1
1.5
2
Si content (mass%)

750
700
650
600
550
500
450
Hardness (Hmv)
Preferred example 2
Preferred example 3
Comparative example 3
100
200
300
Depth (μm)

HIGH FATIGUE-STRENGTH STEEL WIRE AND SPRING, AND PROCESSES FOR PRODUCING THESE

TECHNICAL FIELD

The present invention relates to a steel wire and spring having superior fatigue properties and to a method of manufacturing such a steel wire and spring.

BACKGROUND ART

Spring steel wires containing 0.6–0.8 mass % of C, 0.15–0.35 mass % of Si, and 0.3–0.9 mass % of Mn are known in the art. Such a steel wire is manufactured by being processed through steps of rolling→patenting (heating for γ-phase transition→isothermal transformation→wire drawing→(coiling: when to be worked into springs)→strain relief annealing (at 300±30° C.).

However, it is rather difficult to say that such spring steel wires as mentioned above are satisfactory neither in thermal resistance nor in fatigue strength. Meanwhile, it is known in various steel wires including parallel wire that thermal resistance may be improved by increasing the Si content. In this respect, however, the purpose of using steel wires having a good thermal resistance varies with their specific uses, the thermal resistance for the case of parallel wire essentially aims at limiting the change in tensile strength (TS) of the wire small when subjected to galvanization (at 450° C. for 30 seconds). On the other hand, in the case of those springs associated with automobile engines for which the steel wire of the present invention is intended, important considerations include keeping the permanent set in the temperature range of about 100–200° C. small and at the same time providing desired fatigue properties. Thus, simply applying a chemical composition of such a parallel wire to a spring wire cannot bring forth satisfactory properties sufficient for a spring material. That is to say, while the Si addition in a parallel wire is reportedly said to be effective in improving its fatigue properties, this is mere a story of fatigue under repeated tension, which differs essentially from the fatigue properties required for a spring material. It has been shown that a decrease in surface hardness greatly affects the fatigue properties in a spring steel wire having a high Si content, although its influence on the fatigue properties is small in a parallel wire.

It is also known that a steel wire superior in both thermal resistance and fatigue strength (oil-tempered wire) can be obtained by applying quenching and tempering in the final stage of the steel wire manufacture, such a quenching and tempering process adds to the cost.

Accordingly, it is a primary object of the present invention to provide a steel wire and spring having a high thermal resistance and a high fatigue strength that can be produced without applying a quenching and tempering process, namely, produced through a drawing process and a method of manufacturing such a steel wire and spring.

DISCLOSURE OF THE INVENTION

The present invention provides a steel wire comprising a pearlite structure containing 0.8–1.0 mass % of C and 0.8–1.5 mass % of Si, wherein in the cross section of the steel wire the average hardness in an outer region up to 100 μm from the surface thereof is at least 50 higher than that of a deeper region based on micro-Vickers hardness. This steel wire has a high thermal resistance and fatigue strength, and is particularly suited for spring steel wire. Particularly, it is preferable that the deeper region have an average hardness of 500 or above with the outer region having an average hardness at least 150 higher than that of the deeper region based on micro-Vickers hardness.

Preferably, the steel wire may further contain 0.03–0.1 mass % of Mo. Further, it may contain 0.3–0.9 mass % or less Mn and/or 0.2 mass % or less Cr. For providing a sufficient fatigue strength, this steel wire preferably has a tensile strength above 1,900 N/mm$^2$. In addition, it is preferable the steel wire have a residual surface compression stress of 300 MPa or above.

Further, a method of manufacturing the steel wire according to the present invention is characterized by comprising the steps of: shaving a steel wire of pearlite structure containing 0.8–1.0 mass % of C and 0.8–1.5 mass % of Si; patenting the resultant steel wire, and drawing the patented steel wire; processing the resultant drawn steel wire through a strain relief annealing at 350–450° C.; subsequently subjecting the thus processed steel wire to a shot peening process. This method of manufacture can produce the steel wire of the present invention without resorting to a quenching and tempering process, and can produce a steel wire having a high thermal resistance and fatigue strength at low cost.

For working the steel wire into a spring according to the present invention, a coiling process may be interposed between the drawing and strain relief annealing processes mentioned above. It may also be preferred to provide a nitriding process subsequent to the strain relief annealing. Further, it may be preferable to provide a secondary strain relief annealing at around 250° C. after the above-described shot peening or following the nitriding and the succeeding shot peening processes.

Hereinafter, the aforementioned features of the present invention will be discussed further in detail.

Chemical Composition

C: The lower limit of the C content was determined based on the fatigue strength, while its upper limit was determined based on the wire drawability.

Si: Si is a chemical element essentially required for improvement of thermal resistance. With its content lower than the previously mentioned lower limit no sufficient thermal resistance will be achieved, while the resultant steel wire becomes susceptible to surface flaws if the Si content is higher than its upper limit.

Mo: With an Mo content lower than its lower limit described above it will have a smaller effect on the improvement in the thermal resistance and fatigue strength of the steel wire, while its content exceeding the upper limit will elongate the time required for patenting, resulting in a lowered productivity.

Mn: Mn is added for improving the quench hardenability of steel wire. Mn content exceeding the upper limit tends to increase segregation and lowers wire drawability.

Cr: The aforementioned upper limit is determined, because a longer patenting time becomes required with a Cr content exceeding that level, thus resulting in a lowered productivity.

Shaving

A purpose of the shaving process is to remove a low hardness layer on the surface of steel wire. The fatigue properties are improved by removing those outer layers having a micro-Vickers hardness at least 50 lower than that of the inner portion of steel wire.

Strain Relief Annealing

The strain relief annealing process is applied at 350–450° C. for improving the fatigue properties of resulting springs.

By annealing at temperatures in this range, strains of the steel wire caused in the course of its drawing and coiling processes can be effectively removed. Such high temperatures to which the steel wire is exposed during its strain relief annealing does not lower the strength of the resultant steel wire because of its Si content. An annealing temperature below the lower limit has only a little effect on fatigue properties improvement, while the strength and fatigue strength of wire both decrease if the annealing temperature exceeds its upper limit. A preferable annealing time may be about 20 minutes in view of effects and productivity.

Shot Peening

To secure a high fatigue strength, a spring wire requires a high surface hardness and a large compression stress. Since the strain relief annealing substantially removes strains from the steel wire, it becomes easier for a shot peening process to impart a stress to the wire in process, and thus the resulting steel wires and springs can have excellent fatigue strength.

Nitriding

When subjected to nitriding for imparting a residual stress, the prior art piano wires will have a decreased strength in its matrix structure and therefore such piano wires cannot have a sufficient residual stress even when treated through nitriding and shot peening. Since the steel wire with an increased Si content according to the present invention has an improved heat resistance and undergoes only a small reduction in matrix strength, the compression stress imparted can effectively contribute to the improvement of fatigue strength.

THE BEST MODE FOR CARRYING OUT THE INVENTION

EXPERIMENTAL EXAMPLE 1

Ingots weighing 100kg having chemical compositions shown in Table 1 were melt-cast in a vacuum melting equipment, respectively, and the resultant cast products were worked through hot-forging and rolling into wire rods of 11 mmϕ, respectively.

TABLE 1

| | Chemical composition (mass %) | | | | |
|---|---|---|---|---|---|
| | C | Si | Mn | Cr | Shot peening |
| Preferred example 1 | 0.82 | 1.05 | 0.51 | 0.09 | With |
| Comparative example 1 | 0.82 | 1.05 | 0.51 | 0.09 | Without |
| Comparative example 2 | 0.82 | 0.21 | 0.50 | 0.09 | With |

The resultant wire rods were shaved to remove surface layers to 10 mmϕ and then the shaved wire rods were subjected, under the conditions given below, to patenting, drawing, and strain relief annealing to be worked into steel wires of pearlite structure.

Patenting: 950° C.→lead bath at 580° C.

Drawing: 10 mmϕ→4 mmϕ

Strain relief annealing: at 300° C., 350° C., 400° C., 450° C., 500° C. for 20 min. each In this experiment, three types of steel wire specimens were prepared, among which the steel wire specimens of the preferred example 1 and comparative example 1 were made from a material having the same chemical composition, but the latter example specimens were not worked through shot peening, while the comparative example 2 specimens from a material containing a significantly smaller amount of Si were prepared by being worked through shot peening as the preferred example 1, as shown in Table 1 above. These three types of steel wire specimens were further subjected to a secondary strain relief annealing (at 250° C. for 20 minutes). The shot peening was performed for 20 minutes using 0.3 mmϕ equi-sized steel balls. Then, the resultant specimens were subjected to a fatigue test on a Nakamura's rotating bending fatigue tester with the withstanding minimum fatigue threshold being set at $10^7$ times of bending stress application. The test results of which are given in FIG. 1.

Figure 1:
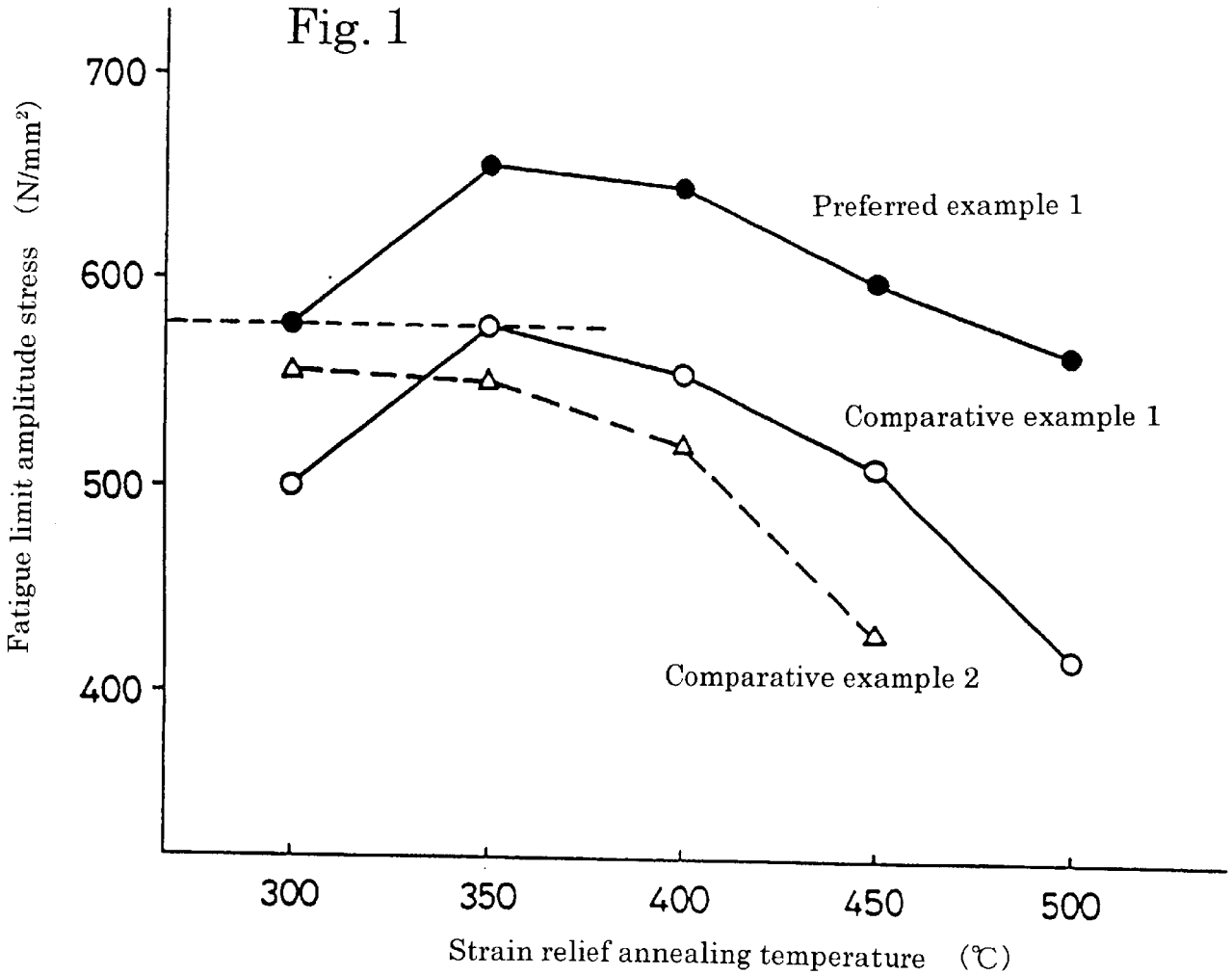
FIG. 1 is a graph showing a relation between strain relief annealing temperature and fatigue limit amplitude stress.

As can be seen in FIG. 1, the steel wires of the preferred example 1 worked through shot peening exhibit a superior fatigue strength with their highest fatigue limit amplitude stresses among others. The comparative example 1 specimens prepared without shot peening and the comparative example 2 specimens with a low Si content prepared with shot peening both show inferiority in fatigue strength. Meanwhile, strain relief annealing yields a satisfiable result in the temperature range of 350 to 450° C.

Then, hardness distribution across the cross section was also determined for each of these three types of steel wires. Regarding the hardness measurement, the strain relief annealing temperature was set at 400° C. for specimens of the preferred example 1 and comparative example 1, and at 300° C. for the comparative example 2 specimens. The test results of which are given in FIG. 2.

Figure 2:
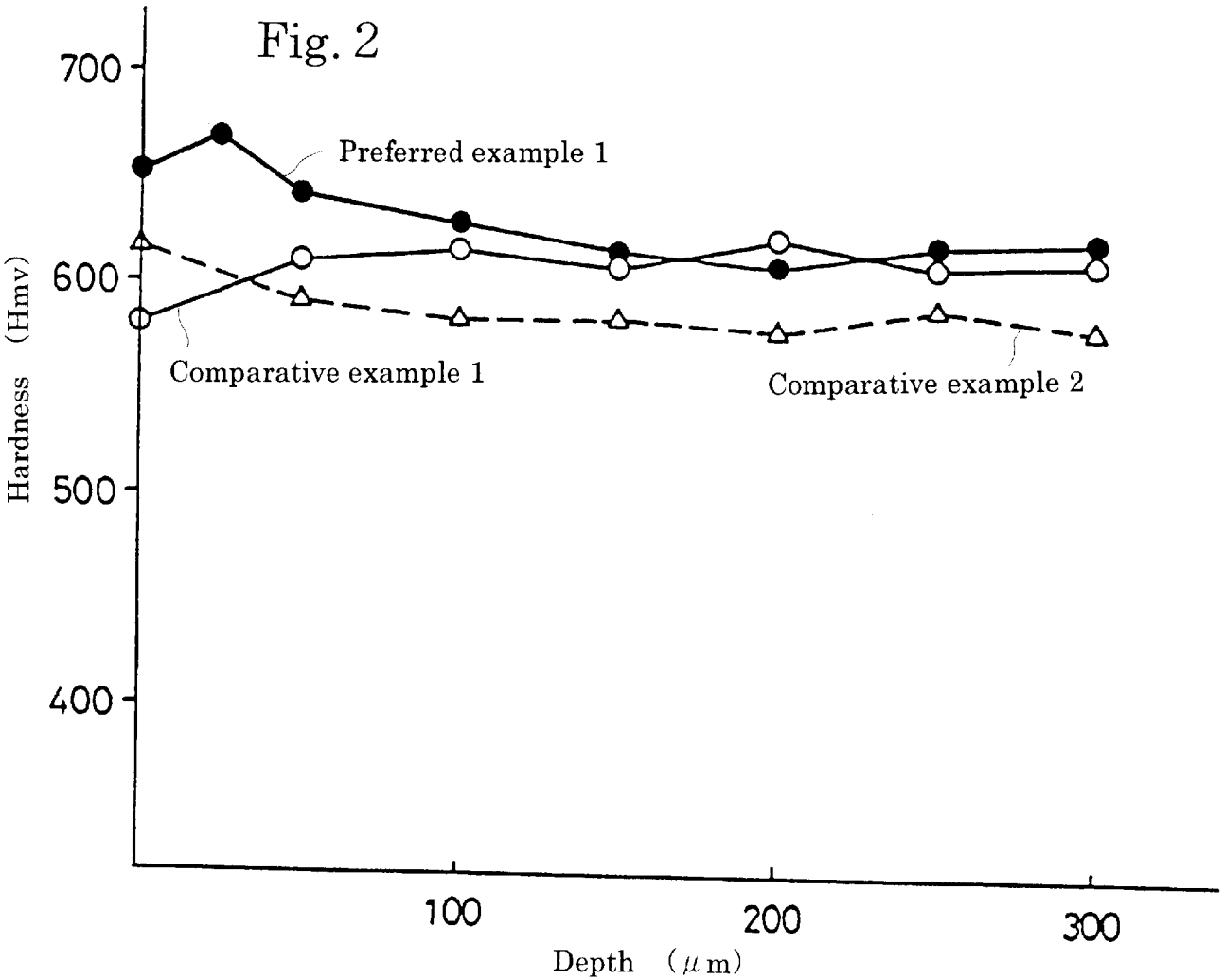
FIG. 2 is a graph showing a hardness distribution across the cross section of each steel wire.

As shown in FIG. 2, the comparative example 1 specimens for which the shot peening was omitted had a lower hardness at a region close to the surface, while the specimens of the preferred example 1 and comparative example 2 had a higher hardness at their corresponding surface regions. In addition, the preferred example 1 specimens showed a generally higher hardness as compared with the comparative example 2 specimens across their cross sections. In particular, as can be seen in FIG. 2, the preferred example 1 specimens had an average hardness of 675 Hmv (micro-Vickers hardness) in a region up to 100 $\mu$m from the surface, with their more inner regions keeping an hardness of 620 Hmv, which was relatively high as compared with the prior art similar steel wires represented by the comparative example 1.

Besides, the steel wire specimens of the respective examples above had the following tensile strengths:

Preferred example 1: 2,140 N/mm$^2$

Comparative example 1: 2,130 N/mm$^2$

Comparative example 2: 1,960 N/mm$^2$

EXPERIMENTAL EXAMPLE 2

In the next place, the same procedure as in the aforementioned preferred example 1 was repeated by using varied C and Si contents, and the resultant steel wires were subjected to a fatigue test in the same manner as in the experimental example 1 above. In this experiment, the strain relief annealing was performed at 300° C. for 20 minutes for specimens with a 0.2 mass % Si content, and at 400° C. for 20 minutes for other specimens. The test results are given in FIG. 3.

Figure 3:
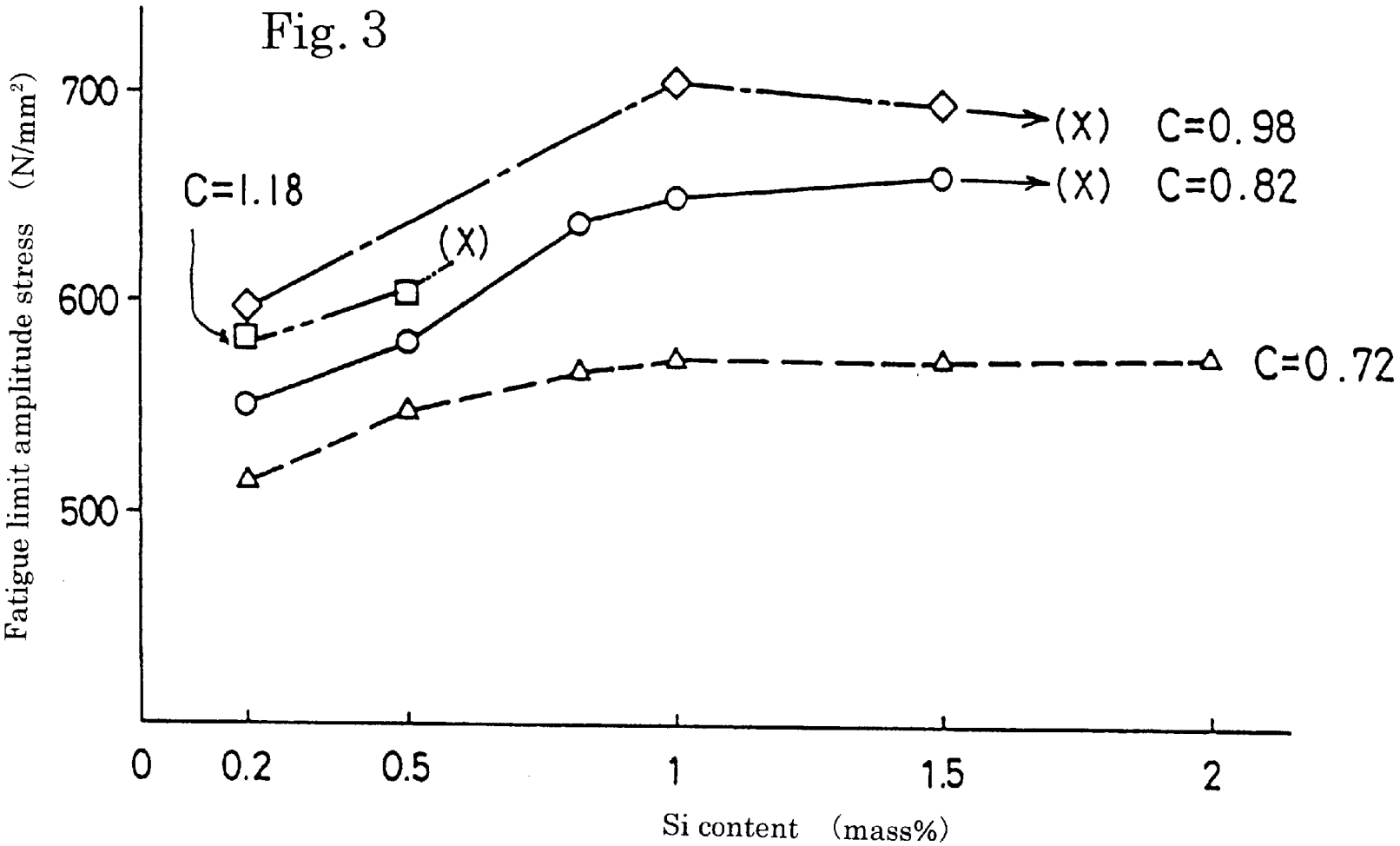
FIG. 3 is a graph showing a relation between Si content and fatigue limit amplitude stress.

In FIG. 3, the curve marked with (x) indicates a failure of experiments, in which the process experienced so frequent occurrence of flaws in process that substantially no specimens could be prepared and thus no fatigue test performed. As can be understood from the graph of FIG. 3, preferable C and Si contents range from 0.7 to 1.0 mass % and 0.8 to 1.5 mass %, respectively.

EXPERIMENTAL EXAMPLE 3

Figure 4:
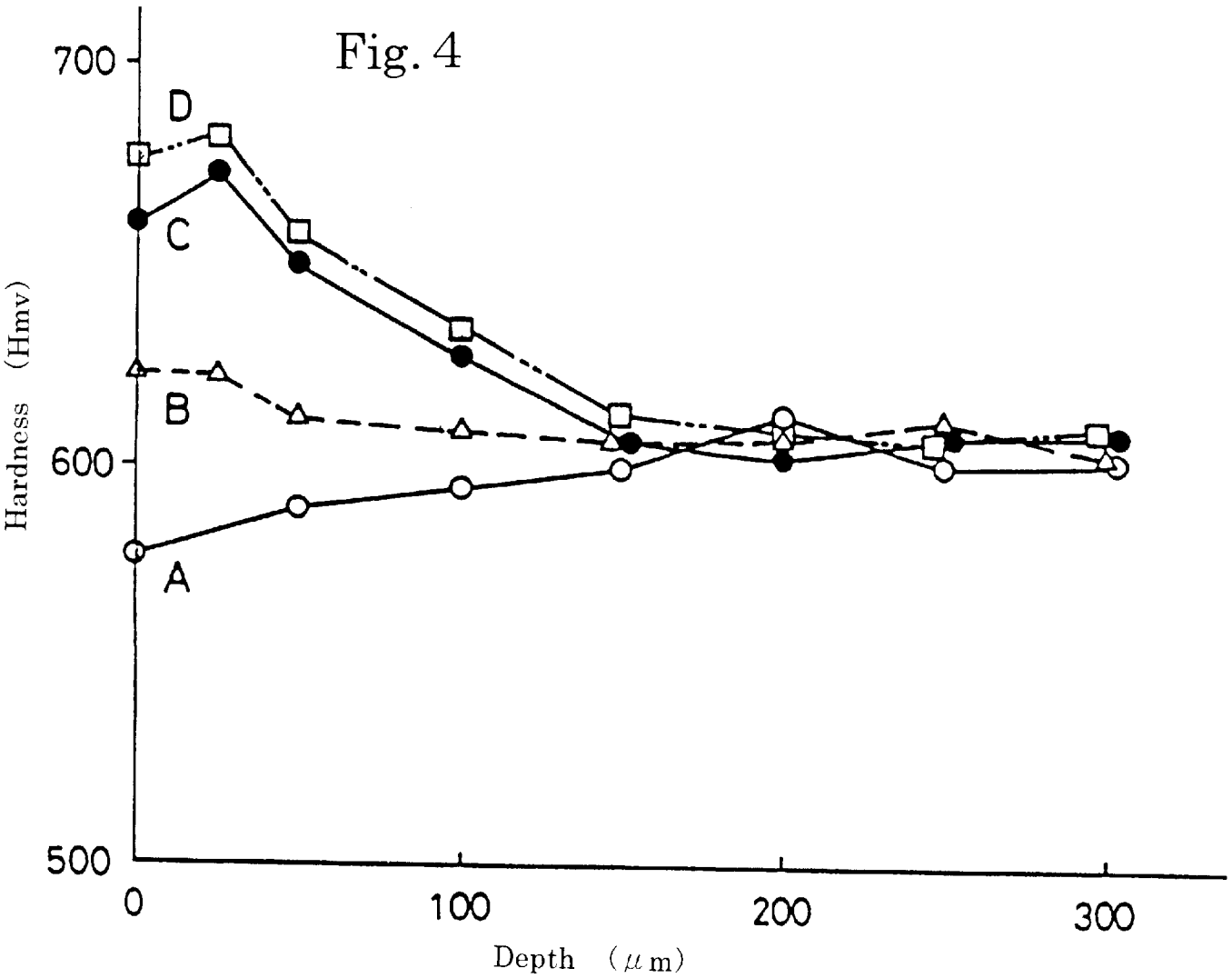
FIG. 4 is a graph showing a relation between hardness distribution over wire cross section and varied shooting conditions in shot peening.

Further, in the same manner as in the preferred example 1 of the aforementioned experimental example 1 (except for the strain relief annealing conditions being limited only to 400° C. for 20 minutes), 4 types of steel wire specimens were prepared under 4 varied shot peening conditions, respectively, and the resultant specimens were tested for hardness distribution across their cross section. The shot peening conditions were varied by changing the shot peening material used and/or shot peening time. The test results are shown in FIG. 4. As can be seen in the graph of FIG. 4, the shot peening applied could produce steel wire specimens in which in their cross sections the average hardness in an outer region up to 100 $\mu$m from the surface thereof was at least 50 higher than that of an inner region based on micro-Vickers hardness. The specimens tested had the following fatigue limit amplitude stresses, respectively:

Specimen A: 575 N/mm$^2$

Specimen B: 590 N/mm$^2$

Specimen C: 660 N/mm$^2$

Specimen D: 690 N/mm$^2$

EXPERIMENTAL EXAMPLE 4

Materials having chemical compositions given below were subjected to the same processes as in the previously described experimental example 1 up to strain relief annealing step (except for the strain relief annealing conditions being limited only to 400° C. for 20 minutes), respectively, and then worked through the respective corresponding processes into steel wire specimens (of the preferred examples 2, 3 and comparative example 3), the resultant specimens being tested for hardness distribution across their cross sections.

PREFERRED EXAMPLE 2

Shot peening followed by secondary strain relief annealing Chemical composition: C: 0.82, Si: 1.35, Mn: 0.51, Cr: 0.09 mass %

PREFERRED EXAMPLE 3

Nitriding followed by shot peening and secondary strain relief annealing

Chemical composition: C: 0.82, Si: 1.35, Mn: 0.51, Cr: 0.09 mass%

COMPARATIVE EXAMPLE 3

Nitriding followed by shot peening and secondary strain relief annealing

Chemical composition: C: 0.82, Si: 0.21, Mn: 0.50, Cr: 0.09 mass %

The shot peening and the secondary strain relief annealing were performed under the same conditions as in the experimental example 1 above, with nitriding being conducted at 450° C. for 2 hours. The test results are shown in FIG. 5.

Figure 5:
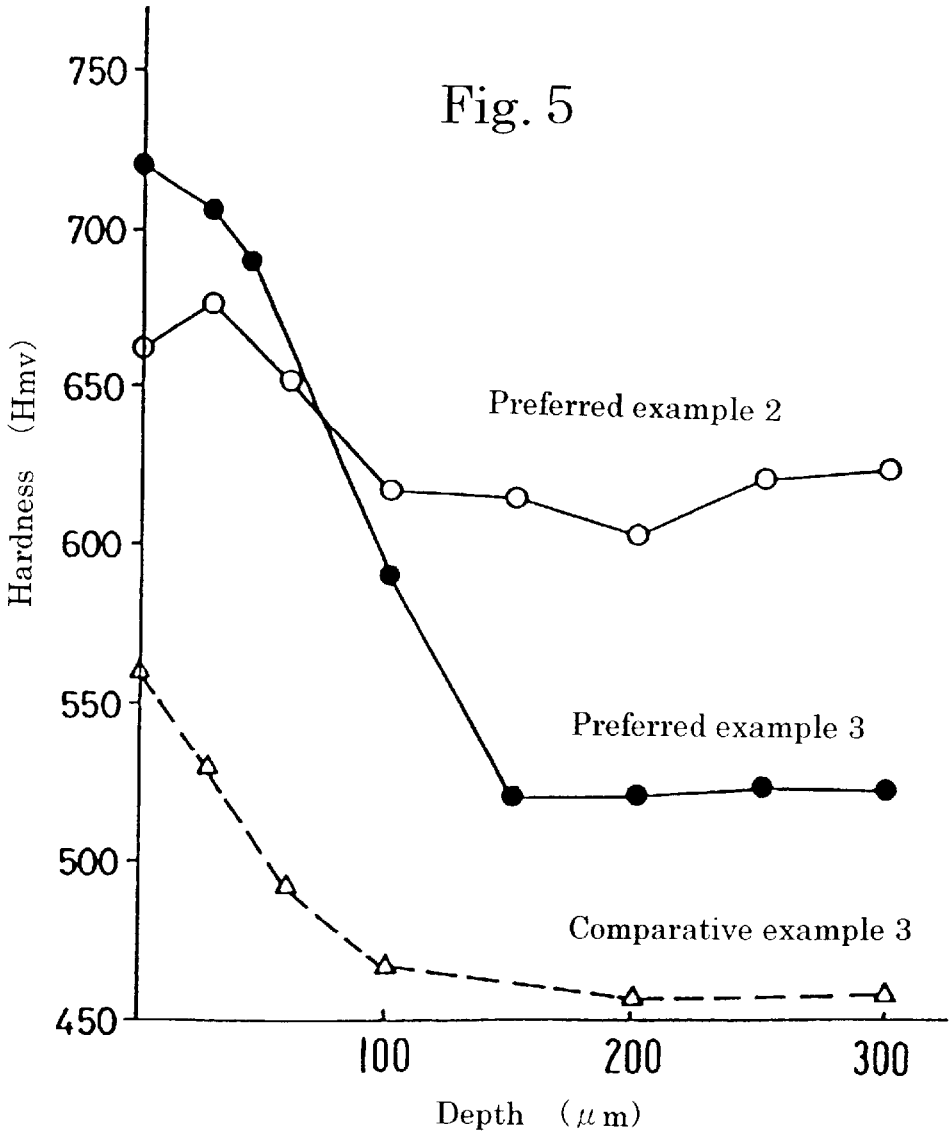
FIG. 5 is a graph is a graph showing a hardness distribution across the cross sections of steel wires worked through nitriding and/or shot peening.

As can be seen in the graph of FIG. 5, the preferred example 2 specimens had in a region within 100 $\mu$m from the surface a surface hardness approximately 55 Hmv higher than that in an inner region across the cross section, while in the preferred example 3 specimens the surface hardness was approximately 150 Hmv higher than the hardness in its inner region. In addition, the preferred example 3 as well as 2 had in the inner region an average hardness above approximately 520 Hmv, which was relatively high as compared with similar steel wires of the prior art. In contrast, the comparative example 3 specimens underwent a substantial reduction in strength by being exposed to high temperatures in the nitriding step, consequently having a low inner region hardness of approximately 470 Hmv with substantially lower surface hardness as compared with any of above two preferred examples.

Figure 6:
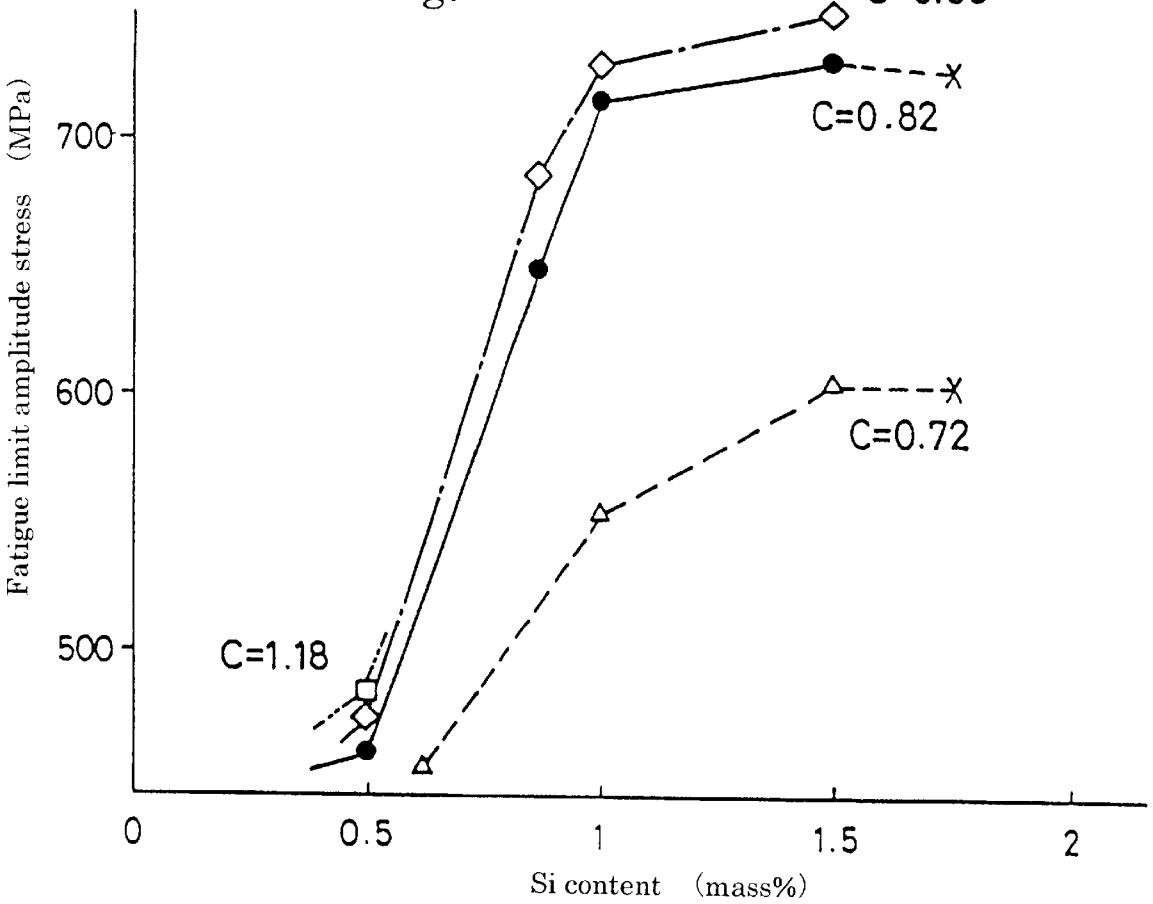
FIG. 6 is a graph showing a relation between Si contents and fatigue limit amplitude stresses of steel wires worked through nitriding and/or shot peening.

Further, the same procedure as in the aforementioned preferred example 3 was repeated by using varied C and Si contents, and the resultant steel wires were subjected to a fatigue test to determine their fatigue limit amplitude stresses. The test results are given in FIG. 6. As can be seen in the graph of FIG. 6, the fatigue limit amplitude stress increases with C and Si contents. However, Si content of 2.0 mass % resulted in an experiment failure because of frequent occurrence of flaws in process. It can be also seen that the fatigue limit amplitude stress decreases significantly if Si content goes down below 0.5 mass %.

In the next place, the specimens of the aforementioned preferred examples 2, 3 and the comparative examples were tested for their residual surface compression stresses. The test results are shown given in Table 2 below along with hardness in their surface and inner regions.

TABLE 2

| | Residual stresses (MPa) | Central hardness of the examples (Hmv) | Surface hardness of the examples (Hmv) | Structure |
|---|---|---|---|---|
| Preferred example 2 | −620 | 618 | 660 | Pearlite |
| Preferred example 3 | −780 | 522 | 720 | Pearlite |
| Comparative example 3 | −430 | 470 | 565 | Pearlite |

As shown in Table 2 above, both the preferred examples 2 and 3 have a high residual surface compression stress to achieve superior fatigue strength and thus are best suited for spring steel wires.

INDUSTRIAL APPLICABILITY OF THE INVENTION

As fully described hereinbefore, the steel wire according to the present invention provided with a high heat resistance and a high fatigue resistance may be effectively used for spring wires. Particularly, the steel wire of the present invention is best suited for springs associated with automobile engines. Besides above, the steel wire of the present invention may be used for stranded PC steel wires, control cables, steel cords, and parallel wires, etc.

What is claimed is:

1. A highly fatigue-resistant steel wire comprising a pearlite structure containing 0.8–1.0 mass % of C and 0.8–1.5 mass % of Si, wherein in the cross section of the steel wire an average hardness in a region up to 100 $\mu$m from the surface thereof is at least 50 higher than that of an inner region based on micro-Vickers hardness.

2. The highly fatigue-resistant steel wire according to claim 1, wherein in the cross section of the steel wire an average hardness in said region up to 100 $\mu$m from the surface thereof is at least 150 higher than that of said inner region based on micro-Vickers hardness.

3. The highly fatigue-resistant steel wire according to claim 1, wherein a tensile strength is approximately 1,900 $N/mm^2$ or above.

4. The highly fatigue-resistant steel wire according to claim 1, wherein a residual surface compression stress is approximately 300 MPa or above.

5. The highly fatigue-resistant steel wire according to claim 1, wherein the average hardness in said inner region is approximately 500 or above based on micro-Vickers hardness.

6. A spring provided with properties substantially equivalent to properties set forth in claims 1.

7. A method of manufacturing a highly fatigue-resist steel wire comprising the steps of:

shaving a steel wire rod of pearlite structure containing 0.8–1.0 mass % of C and 0.8–1.5 mass % Si;

patenting the shaved wire rod;

drawing the patented wire rod into wire;

subjecting the resultant wire to strain relief annealing at 350–450° C. without subjecting the same to quenching and tempering process; and shot peening the resultant wire.

8. The method according to claim 7, wherein there is further provided a step of nitriding succeeding to said strain relief annealing.

9. A method of manufacturing a spring comprising the steps set forth in claim 7, wherein there is further provided a step of coiling as interposed between said steps of drawing and strain relief annealing.

* * * * *

UNITED STATES PATENT AND TRADEMARK OFFICE

CERTIFICATE OF CORRECTION

PATENT NO. : 6,627,005 B1
DATED : September 30, 2003
INVENTOR(S) : Nozomu Kawabe et al.

It is certified that error appears in the above-identified patent and that said Letters Patent is hereby corrected as shown below:

Title page,
Item [54], change the Title from "HIGH FATIGUE-STRENGTH STEEL WIRE AND SPRING, AND PROCESSES FOR PRODUCING THESE" to -- HIGHLY FATIGUE-RESISTANT STEEL WIRE AND SPRING AND METHOD OF MANUFACTURING THE SAME --
Item [*] Notice, change "0" to -- 361 --

Signed and Sealed this

Twenty-seventh Day of April, 2004

JON W. DUDAS
*Acting Director of the United States Patent and Trademark Office*